US005917457A

United States Patent [19]

Lopez

[11] Patent Number: 5,917,457

[45] Date of Patent: Jun. 29, 1999

[54] U-DIPOLE RADIATING ELEMENTS AND ANTENNAS

[75] Inventor: Alfred R. Lopez, Commack, N.Y.

[73] Assignee: Marconi Aerospace Systems Inc. Advanced Systems Division, Greenlawn, N.Y.

[21] Appl. No.: 08/803,658

[22] Filed: Feb. 21, 1997

[51] Int. Cl.[6] ..... H01Q 9/30

[52] U.S. Cl. ..... 343/828; 343/825

[58] Field of Search ..... 343/825, 828, 343/700 MS, 713, 795, 821, 702, 814

[56] References Cited

U.S. PATENT DOCUMENTS

| | | | |
|---|---|---|---|
| 4,800,393 | 1/1989 | Edward et al. | 343/821 |
| 5,406,295 | 4/1995 | Barinski et al. | 343/713 |
| 5,451,971 | 9/1995 | Grossman et al. | 343/828 |
| 5,526,003 | 6/1996 | Ogawa et al. | 343/713 |
| 5,532,708 | 7/1996 | Krenz et al. | 343/795 |
| 5,724,051 | 3/1998 | Mailandt et al. | 343/795 |

*Primary Examiner*—Don Wong
*Assistant Examiner*—Hoang Nguyen
*Attorney, Agent, or Firm*—Edward A. Onders; Kenneth P. Robinson

[57] ABSTRACT

U-dipole radiating elements (10) and associated feed conductors (20, 22) are cut or stamped from brass sheet stock. Each U-dipole (10) is then bent up at 90 degrees to the signal distribution conductor (22) which is supported in front of a reflector (12). The U-dipole element (10) includes a first dipole-type conductor segment (14) connected near one end to a feed segment (20) which is the sole signal feed path to the U-dipole element. A second dipole-type conductor segment (16), which is spaced from and parallel to and coextensive with first segment (14), is connected to the other end of the first segment (14). An antenna may include one or more individual U-dipole elements cut from sheet stock and connected to feed points. In a linear array antenna configuration, a group of U-dipole elements (10*a*–10*b*) and associated signal feed network components may be cut in a unitary form from a sheet of conductive material and supported in front of a reflector surface. This provides a relatively simple, low cost antenna with a minimum of junctions between components and capable of providing low intermodulation product performance.

19 Claims, 5 Drawing Sheets

U-DIPOLE RADIATING ELEMENTS AND ANTENNAS

BACKGROUND OF THE INVENTION

This invention relates to radiating elements and antennas and, more particularly, to forms of dual-dipole single-feed radiating elements having a U configuration.

For a variety of reasons it is desirable to provide highly reliable, low cost antennas suitable for meeting the requirements of cellular communication applications. As a result of operational characteristics of cellular systems, spurious intermodulation effects which may be produced in antennas at electrical contact points are particularly undesirable. Contact points or physical connections existing where radiating elements are interconnected or are connected to feed lines may give rise to such intermodulation products. Intermodulation product (IMP) problems may thus result from bimetallic contacts, corrosion effects over time, and combinations of materials resulting in contact points with semiconductor-like characteristics.

While simplicity of construction and low cost construction are common objectives in antenna design, in cellular applications such objectives may directly correspond to considerations important to achieving the lowest levels of intermodulation effects. Thus, a complex, many component antenna may provide a variety of possible sources of intermodulation effects. Conversely, if a simple one-piece radiating element construction could be provided with a reduced number of component contact points, sources of intermodulation effects would be avoided. At the same time, benefits of low cost and ease of assembly could also be achieved. Many of these objectives are achieved in copending application Ser. No. 08/518,059, titled "Low Intermodulation Electromagnetic Feed Cellular Antennas" and commonly assigned with the present application.

Objects of the present invention are to provide new and improved radiating elements and antennas utilizing such elements having one or more of the following advantages or characteristics:

dual-dipole U configuration;

one piece element and feed construction;

short length single conductor feed;

self-supported by short feed conductor;

low profile from back reflector;

unitary element stamped from sheet stock; and an array of radiating elements, with interconnecting signal distribution network, producible in one piece from brass or other conductive sheet stock.

SUMMARY OF THE INVENTION

In accordance with the invention, an antenna utilizing dual-dipole single-feed radiating elements of U configuration includes a reflector and a signal distribution conductor extending nominally parallel to the reflector. The antenna also includes a plurality of radiating elements each having:

a first linear conductor segment spaced from and nominally parallel to the reflector;

a second linear conductor segment spaced from and nominally parallel to and coextensive with the first segment, the second segment having one end connected to a first end of the first segment to form a U configuration; and a feed segment connected at a point along the first segment spaced from the first end thereof, with the feed segment connected to the signal distribution conductor to provide the sole signal feed path to the first and second segments.

For a better understanding of the invention, together with other and further objects, reference is made to the accompanying drawings and the scope of the invention will be pointed out in the accompanying claims.

DESCRIPTION OF THE INVENTION

Figure 1:
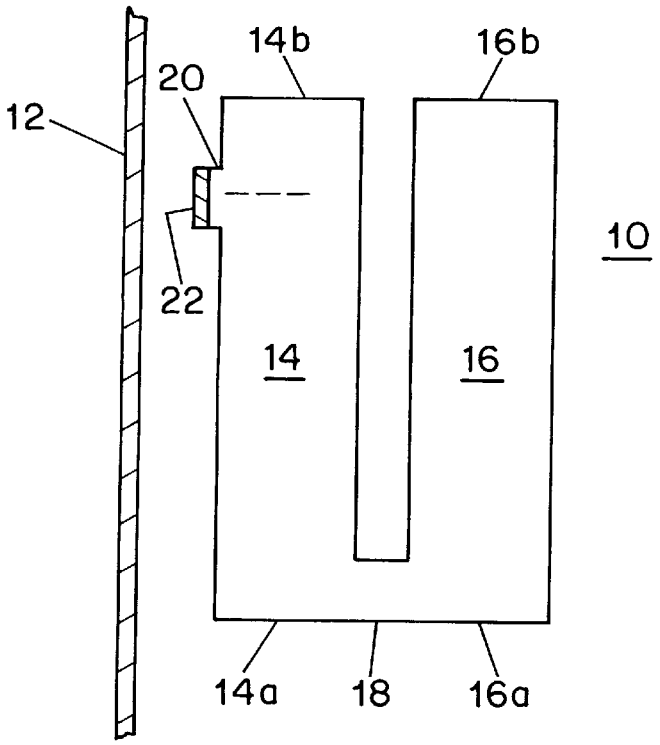
FIG. 1 is a side view of a U-dipole radiating element in accordance with the invention.
Figure 2:
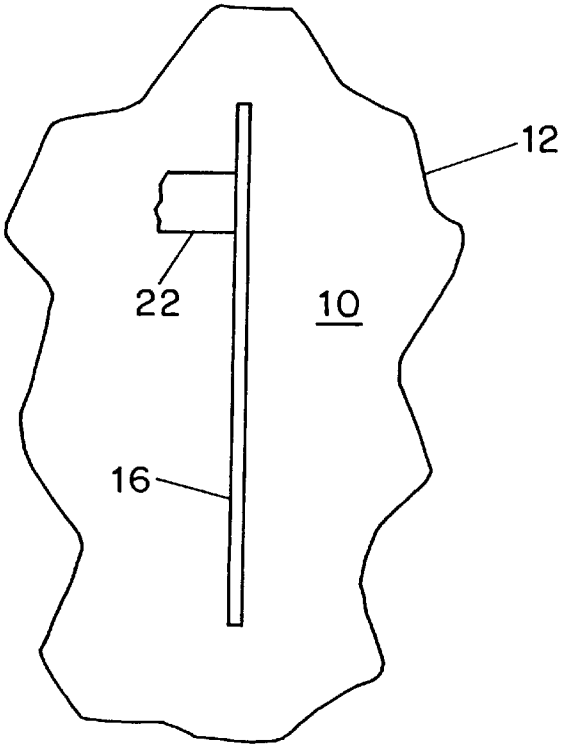
FIG. 2 is a front view of the U-dipole radiating element of FIG. 1.

FIG. 1 is a side view of a dual-dipole single-feed radiating element 10 in accordance with the invention, suspended in front of a section of a planar back reflector 12. FIG. 2 is a front view of the FIG. 1 radiating element, which may be termed a U-dipole element. Radiating element 10, which is of a U configuration as shown, includes a first linear conductor segment 14 and second linear conductor segment 16. As shown, first segment 14 is a section of conductive material, such as brass sheet stock, approximately one-half wavelength long at a frequency in an operating range and is spaced from and nominally parallel to the front face of reflector 12. Segment 14 is effective for use as a radiating element having characteristics typically associated with dipole-type radiating elements.

Second segment 16 is similar to the first segment 14. As shown, second segment 16 is spaced from and nominally parallel to and coextensive with first segment 14. One end 16*a* of second segment 16 is connected to a first end 14*a* of first segment 14, by a bridge segment 18. As shown, segments 14 and 16 are coextensive, in that they are the same length and the ends 16*a* and 16*b* of second segment 16 are respectively aligned with the first and second ends 14*a* and 14*b* of first segment 14. It will be appreciated that while segments 14 and 16 will typically be coextensive and be positioned parallel to each other and to reflector 12, in some embodiments particular considerations may result in departures from strict length equality and parallel alignment. For this purpose, "nominally" is defined as being within plus or minus twenty percent of a stated condition or relationship, in order to cover elements which are not exactly coextensive, for example, but which are nominally coextensive.

In FIG. 1, radiating element 10 also includes a feed segment 20 connected at a point along first segment 14 which is spaced from first end 14*a* to which second segment 16 is connected. In a typical configuration, feed segment 20 may connect to first segment 14 with the midpoint of feed segment 20 (dashed line in FIG. 1) spaced nominally 0.07 wavelength from second end 14*b* of the first segment. Pursuant to the invention, the dual-dipole U configuration radiating element 10 is designed for operation with feed segment 20 providing the sole signal feed path to both of the first and second dipole segments 14 and 16.

Figure 3:
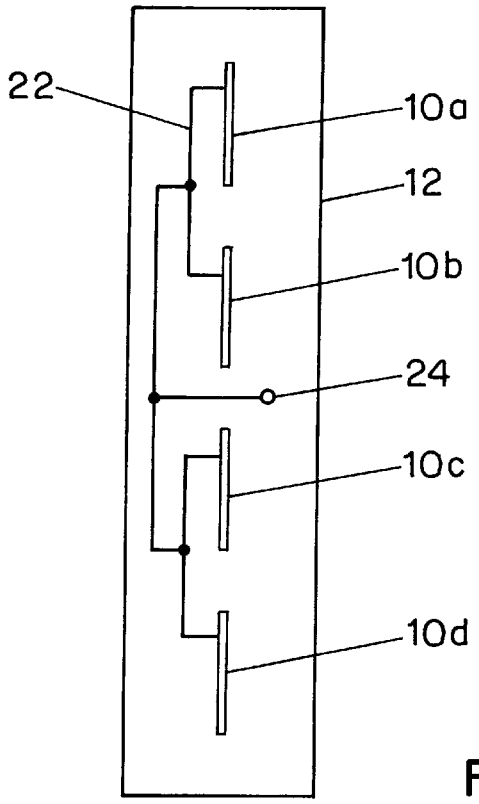
FIG. 3 is a simplified representation of an array antenna including U-dipole radiating elements of the type shown in FIG. 1.

As shown in FIG. 1, the radiating element 10 may additionally comprise a portion of a signal distribution conductor 22 connected to feed segment 20. A short portion of signal distribution conductor 22, which extends perpendicular to first segment 14 and parallel to the surface of reflector 12, is shown in cross section in FIG. 1 and its front surface is shown in the front view of FIG. 2. With the illustrated construction, a portion of the signal distribution conductor 22 may be considered to be a part of the radiating element 10. FIG. 3 shows a complete signal distribution conductor configuration in a schematic type format for a four element array antenna. FIG. 3 is a front view, similar to the FIG. 2 view, of an array antenna including elements 10*a*, 10*b*, 10*c* and 10*d*, each of which has the form of element 10 of FIGS. 1 and 2. In FIG. 3, the elements are connected to a parallel type signal distribution conductor 22, which also connects to an input/output port 24 which may be a coaxial connector passing through reflector 12. Signal distribution conductor 22 in this embodiment may be spaced from the face of reflector 12 in parallel relationship and supported by suitable insulative spacers fixed to the reflector. Depending upon structural requirements, the radiating elements 10*a*–10*d* may be physically supported solely by the signal distribution conductor 22, by insulative supports fixed to the reflector, or in other suitable fashion. The drawings are not necessarily to scale and certain dimensions are distorted for clarity of presentation.

In implementation of the configuration as described, radiating elements 10*a*–10*d*, together with all or a significant portion of signal distribution conductor 22 as represented in FIG. 3, may be cut or stamped as a single unitary pattern from a sheet of brass stock or other conductive material. The respective radiating elements 10*a*–10*d* may then be bent at the junction of feed segment 20 with signal distribution conductor 22 so that the radiating elements are each normal to conductor 22, as shown in FIGS. 1 and 2. With this arrangement, the signal distribution/radiating element structure includes a minimum of joints or electrical connections and, when supported in front to the reflector 12, may be protected by a suitable radome. To provide signal access, input/output port 24 may be a coaxial connector fixture passing through reflector 12 to enable coaxial cable connection from the back of reflector 12 for antenna feed purposes. A reflector, signal distribution conductor supported in spaced parallel relation to the reflector and associated connector, radome and other elements are disclosed and described in copending application Ser. No. 08/518,059, filed Aug. 22, 1995, titled "Low Intermodulation Electromagnetic Feed Cellular Antennas" and having a common assignee. That application, which is hereby incorporated herein by reference, utilizes a signal distribution conductor and associated insulative supports and other elements in combination with an electromagnetic feed element design which is dissimilar to the U configuration radiating elements of the present invention. Persons skilled in the art will be capable of adapting signal distribution, support, radome and other relevant features of the referenced application for use in antennas utilizing the present invention. Alternatively, other appropriate arrangements and configurations may be utilized in application of the invention. In particular, while a signal distribution network and radiating elements may be fabricated in one piece as described, U-dipoles may also be formed individually. Thus, the FIG. 1 element 10 may be formed without signal distribution conductor 22 and may then be utilized in an antenna with connection to a signal feed point in any manner suitable to enable electrical coupling and mechanical support of radiating element 10.

Figure 4:
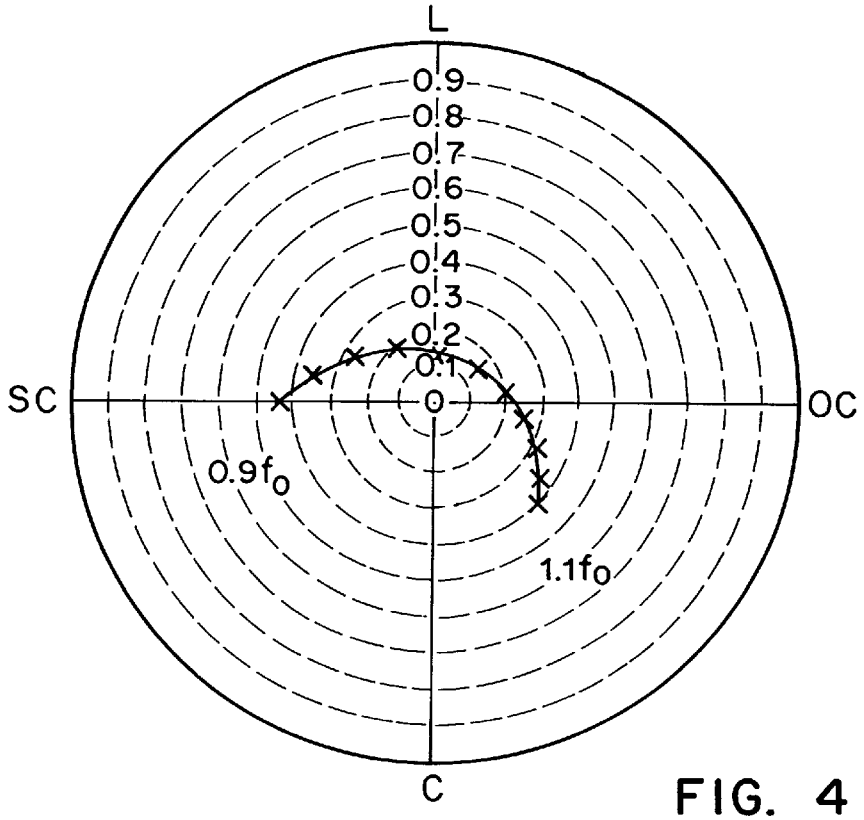
FIG. 4 is a computed impedance plot for a FIG. 1 type antenna.

Referring now to FIG. 4, there is shown a computed impedance plot for an antenna design in accordance with FIG. 1. In this antenna design, the first and second dipole segments 14 and 16 were each approximately 0.36 wavelength in length and 0.1 wavelength in width, and spaced apart by approximately 0.05 wavelength, relative to the center frequency of an operating band. In this design, feed segment 20 was approximately 0.001 wavelength long (between segment 14 and conductor 22) and signal distribution conductor 22 was supported at a spacing of approximately 0.01 wavelength from the face of reflector 12 (to provide a 50 ohm feed). With this configuration, the 2:1 VSWR bandwidth and 1.5:1 VSWR bandwidth were indicated to be 14.5 percent and 9.5 percent of the center frequency, respectively.

Figure 5:
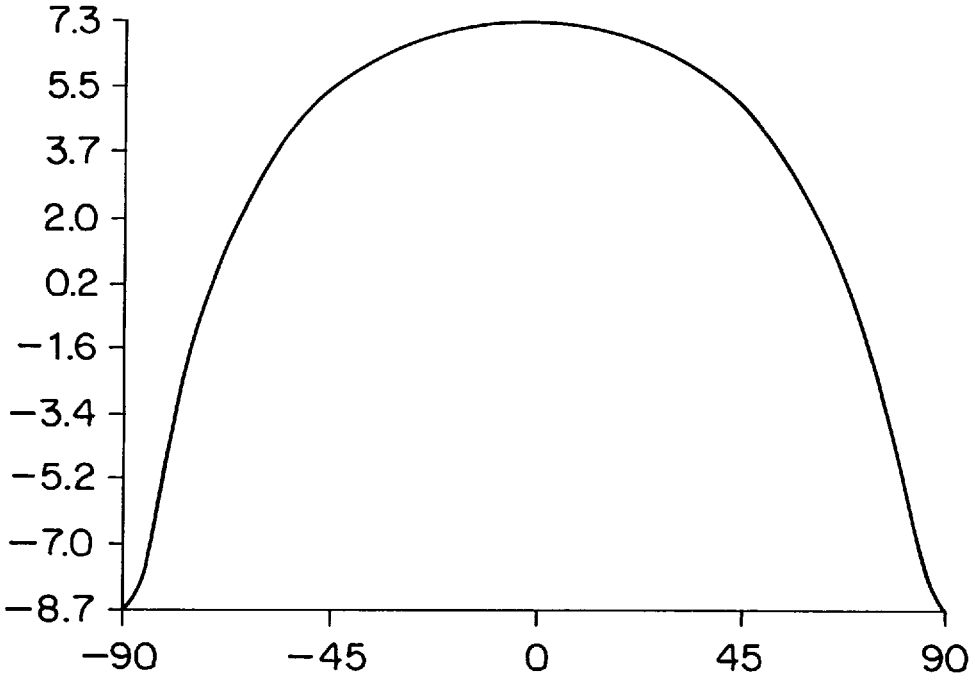
FIGS. 5, 6 and 7 are computed azimuth plane radiation patterns for a FIG. 1 type antenna at respective frequencies of 90, 100 and 110 percent of operating band center frequency.
Figure 6:
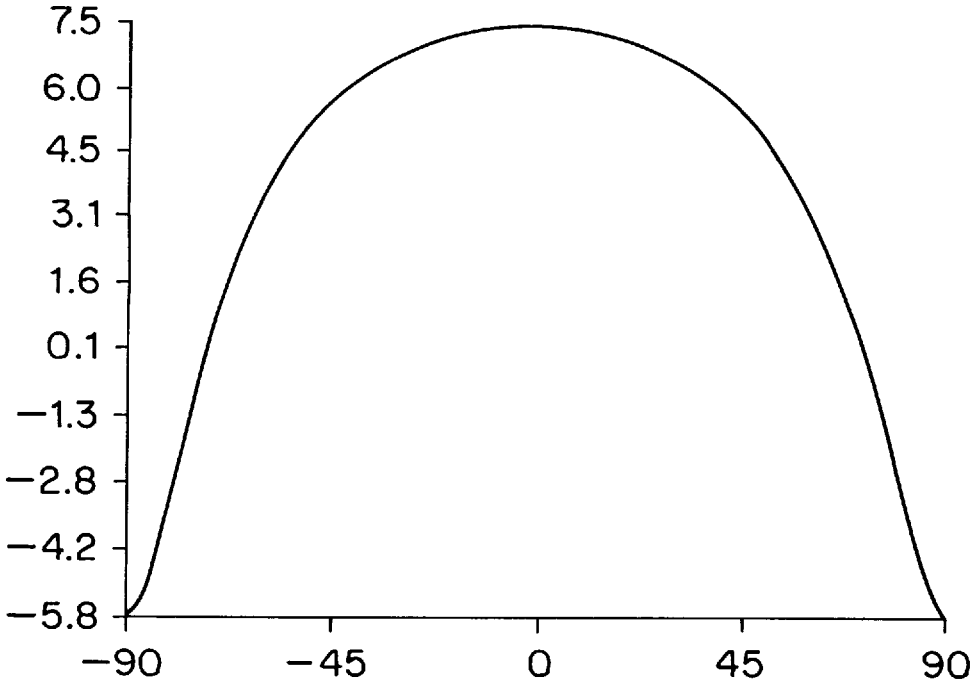
Figure 7:
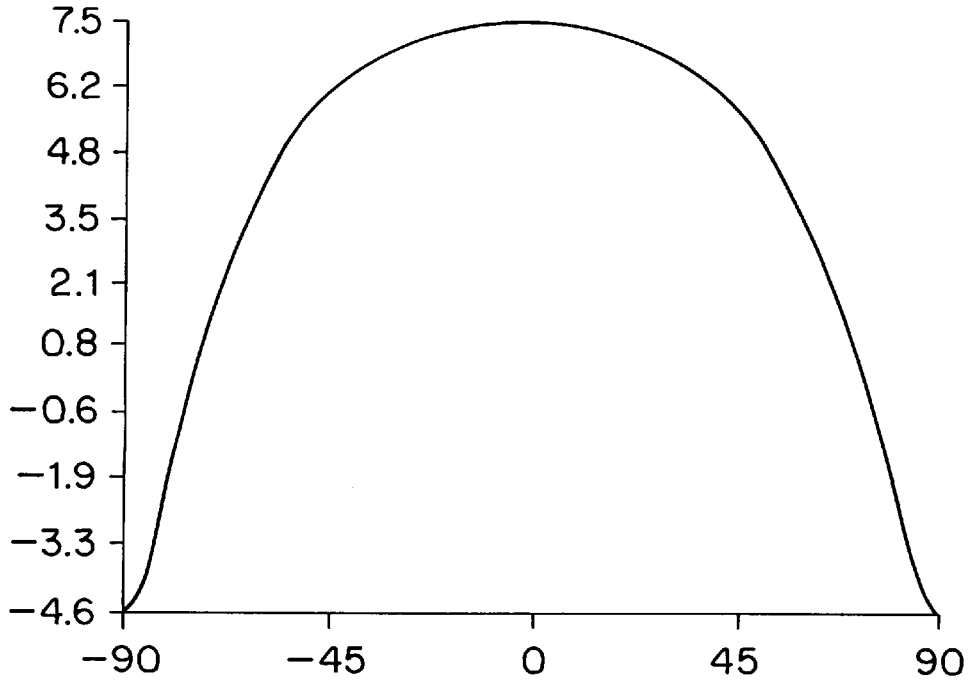
Figure 8:
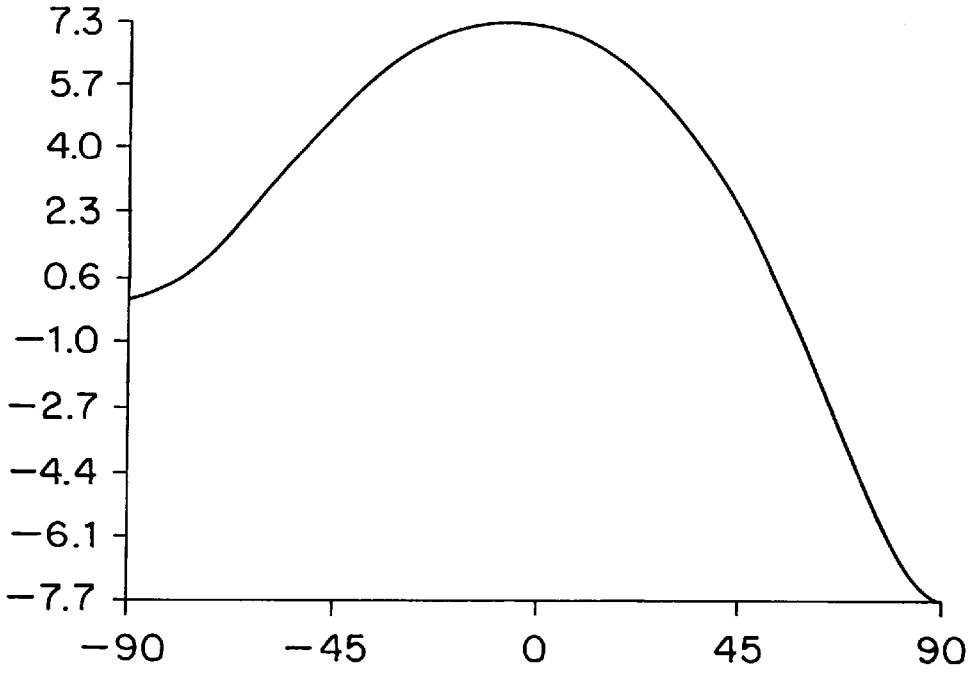
FIGS. 8, 9 and 10 are computed elevation plane radiation patterns for a FIG. 1 type antenna at respective frequencies of 90, 100 and 110 percent of operating band center frequency.
Figure 9:
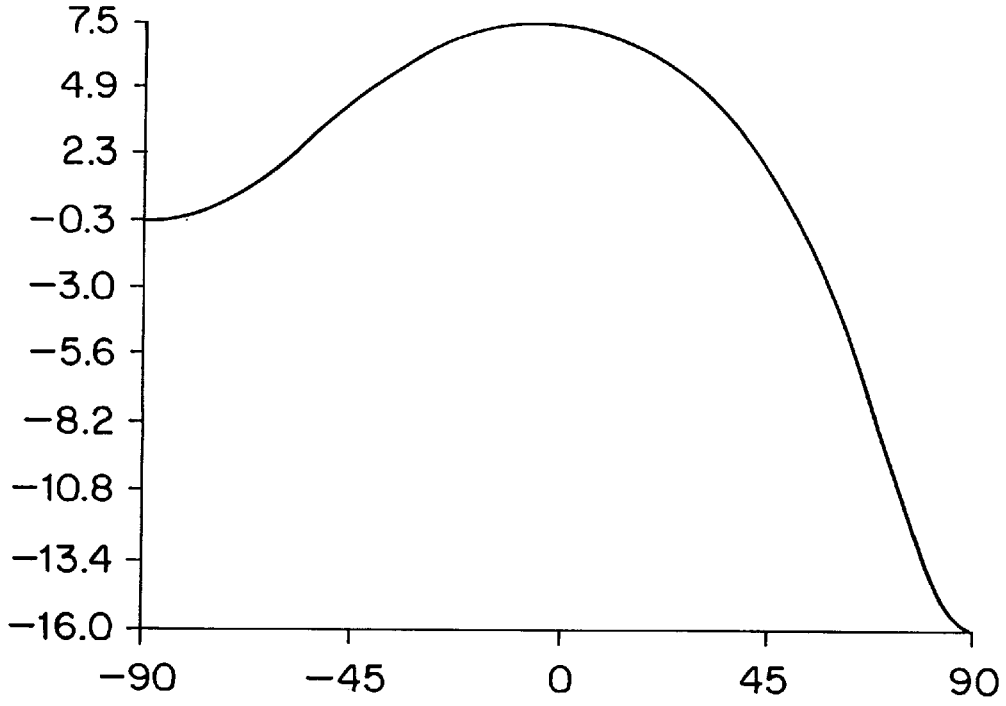
Figure 10:
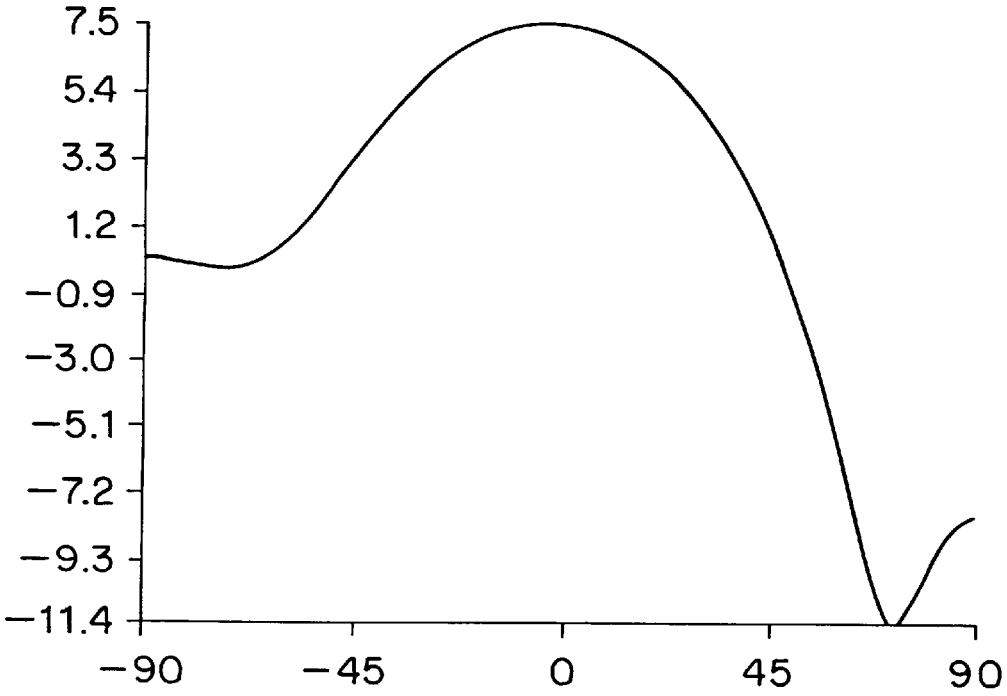

The computed azimuth plane patterns, as shown in FIGS. 5, 6 and 7, provide azimuth beamwidths of 104, 108 and 111 degrees at frequencies equal to 90, 100 and 110 percent of the center frequency of an operating band, respectively. FIGS. 8, 9 and 10 show computed elevation plane beamwidths of 83, 76 and 69 degrees for the same respective frequencies. The elevation plane patterns are not symmetrical about zero degrees elevation. The beam peaks are tilted down about 2.5 degrees below horizontal. While the computed patterns for this particular design implementation clearly show the capability of the invention to provide acceptable operating results, while also enabling low IMP with simple unitary dipole and feed construction, it will be appreciated that skilled persons will be capable of applying the invention in a variety of implementations suited for various applications.

While there have been described the currently preferred embodiments of the invention, those skilled in the art will recognize that other and further modifications may be made without departing from the invention and it is intended to claim all modifications and variations as fall within the scope of the invention.

What is claimed is:

1. A dual-dipole single-feed radiating element of U configuration for radiating in a forward direction, comprising:

a first dipole comprising a first linear conductor segment;

a second dipole comprising a second linear conductor segment spaced from and nominally parallel to and coextensive with said first segment, said second segment having one end connected to a first end of said first segment to form a U configuration with said first and second segments transverse to, and spaced apart in, said forward direction; and a feed segment connected at a point along said first segment spaced from said first end thereof, to provide a sole signal feed path to said first and second segments; and a signal distribution conductor connected to said feed segment and extending nominally perpendicular to said first linear conductor segment and perpendicular to said forward direction;

said radiating element and said signal distribution conductor formed in one piece from a conductive sheet, and said radiating element bent to a position nominally perpendicular to said signal distribution conductor.

2. A radiating element as in claim 1, wherein said radiating element with said signal distribution conductor are cut or stamped in one piece from brass sheet stock.

3. A radiating element as in claim 1, wherein the midpoint of said feed segment is spaced from said first end of said first segment by nominally 0.07 wavelength, relative to a frequency in an operating band.

4. A radiating element as in claim 1, wherein said second segment is supported solely by said first segment, which is supported solely by said feed segment.

5. A radiating element as in claim 4, wherein said feed segment is supported solely by a signal distribution conductor.

6. A radiating element as in claim 1, wherein said first and second segments are each nominally 0.36 wavelength in length, nominally 0.1 wavelength in width and spaced apart by nominally 0.05 wavelength, relative to a frequency in an operating band.

7. A radiating element as in claim 1, wherein said first and second segments are of flat construction with main surfaces lying in a plane which is nominally parallel to said forward direction and perpendicular to said signal distribution conductor.

8. An antenna as in claim 9, wherein said first and second segments are of flat construction with main surfaces lying in a plane which is nominally perpendicular to the reflector.

9. An antenna including a dual-dipole single-feed radiating element of U configuration, the antenna comprising:

a reflector;

a signal distribution conductor extending nominally parallel to said reflector; and a dual-dipole first radiating element having:

a first linear conductor segment spaced from and nominally parallel to said reflector;

a second linear conductor segment spaced from and nominally parallel to and coextensive with said first segment, said second segment having one end connected to a first end of said first segment to form a U configuration; and a feed segment connected at a point along said first segment spaced from said first end thereof, said feed segment connected to said signal distribution conductor to provide a sole signal feed path to said first and second segments;

said first radiating element aligned so that said first segment is positioned between said second segment and the reflector.

10. An antenna as in claim 9, wherein said radiating element is formed in one piece from a conductive sheet.

11. An antenna as in claim 9, wherein said radiating element, including a bridge segment providing the connection between said first and second segments, is cut or stamped in one piece from brass sheet stock.

12. An antenna as in claim 9, wherein said radiating element and said signal distribution conductor are cut or stamped in one piece from conductive sheet stock.

13. An antenna as in claim 9, wherein the midpoint of said feed segment is spaced from said first end of said first segment by nominally 0.07 wavelength, relative to a frequency in an operating band.

14. An antenna as in claim 9, wherein said second segment is supported solely by said first segment, which is supported solely by said feed segment.

15. An antenna as in claim 14, wherein said feed conductor is supported solely by said signal distribution conductor.

16. An antenna as in claim 9, wherein said first and second segments are each nominally 0.36 wavelength in length, nominally 0.1 wavelength in width and spaced apart by nominally 0.05 wavelength, relative to a frequency in an operating band.

17. An antennas as in claim 9, including an additional plurality of radiating elements each identical to said first radiating element and each connected to said signal distribution conductor.

18. An antenna as in claim 17, wherein said signal distribution conductor is arranged to provide parallel coupling of signals between said radiating elements and an input/output port.

19. An antenna as in claim 17, wherein all of said radiating elements and at least a portion of said signal distribution conductor are formed in one piece from a sheet of conductive material.

* * * * *